US007150330B2

(12) United States Patent
Domann

(10) Patent No.: US 7,150,330 B2
(45) **Date of Patent: *Dec. 19, 2006**

(54) HYDRAULIC CIRCUIT AND METHOD FOR OPERATING A GRIPPING DEVICE

(75) Inventor: Robert E. Domann, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 328 days.

This patent is subject to a terminal disclaimer.

(21) Appl. No.: 10/840,787

(22) Filed: May 6, 2004

(65) Prior Publication Data

US 2005/0247455 A1 Nov. 10, 2005

(51) Int. Cl.
*E21B 19/22* (2006.01)

(52) U.S. Cl. ..... 166/386; 166/77.3

(58) Field of Classification Search ..... None
See application file for complete search history.

(56) References Cited

U.S. PATENT DOCUMENTS 4,534,168 A * 8/1985 Brantly ..... 60/369
6,173,769 B1 1/2001 Goode ..... 166/77.3
6,216,780 B1 4/2001 Goode et al. ..... 166/77.3
6,367,557 B1 4/2002 Rosine et al. ..... 166/384
7,032,499 B1 * 4/2006 Domann ..... 91/443
2003/0209346 A1 11/2003 Austbo et al. ..... 166/77.2

OTHER PUBLICATIONS

Patent Application entitled "Apparatus and Method for Injecting Tubing in a Well Bore" by Robert E. Domann et al., filed concurrently herewith.

* cited by examiner

*Primary Examiner*—Zakiya W. Bates
(74) *Attorney, Agent, or Firm*—John W. Wustenberg; Haynes & Boone

(57) ABSTRACT

A hydraulic circuit and method for operating a gripping mechanism according to which fluid is passed from a source to the device while some of the fluid is passed to a valve that is adjustable to control the amount of fluid passed to it and therefore the amount of fluid passed to the device.

58 Claims, 5 Drawing Sheets

HYDRAULIC CIRCUIT AND METHOD FOR OPERATING A GRIPPING DEVICE

BACKGROUND

The present invention relates to a hydraulic circuit connected to an injector for injecting coiled tubing into a well, and a method of controlling the gripping of the tubing associated therewith.

Many coiled tubing injectors utilize a hydraulic circuit to control movement of one or more components of the injector in order to grip and advance the coiled tubing through the injector and to the well.

Several potential problems arise during the operation of a typical injector hydraulic circuit. In particular, if the diameter of the tubing increases during the operation of a typical injector hydraulic circuit, there may be an unsafe pressure increase in the circuit. Also, many injector hydraulic circuits require a human operator to move near the injector during operation to adjust the gripping pressure on the tubing, thus increasing the risk of harm to the operator.

Further, if there is a loss of pressure to the injector hydraulic circuit, the tubing will be released, thus creating a "runaway" situation whereby the released tubing could cause harm to the operator and significantly damage the injector and the well. Current runaway-prevention solutions include using a shut-off valve to isolate the injector hydraulic circuit after a loss of pressure, or connecting a check valve upstream of the injector hydraulic circuit to hold the pressure in the injector hydraulic circuit. Although these solutions prevent a complete loss of pressure to the injector hydraulic circuit, they do not provide an easy and safe way for the human operator to resume control of the injector hydraulic circuit after the pressure has been restored. In addition, neither of these solutions enables the gripping pressure on the tubing to be increased in the event of an unforeseen failure in operator-house pressure.

Therefore, what is needed is an injector for advancing coiled tubing into a well that overcomes these problems.

DETAILED DESCRIPTION

Figure 1:
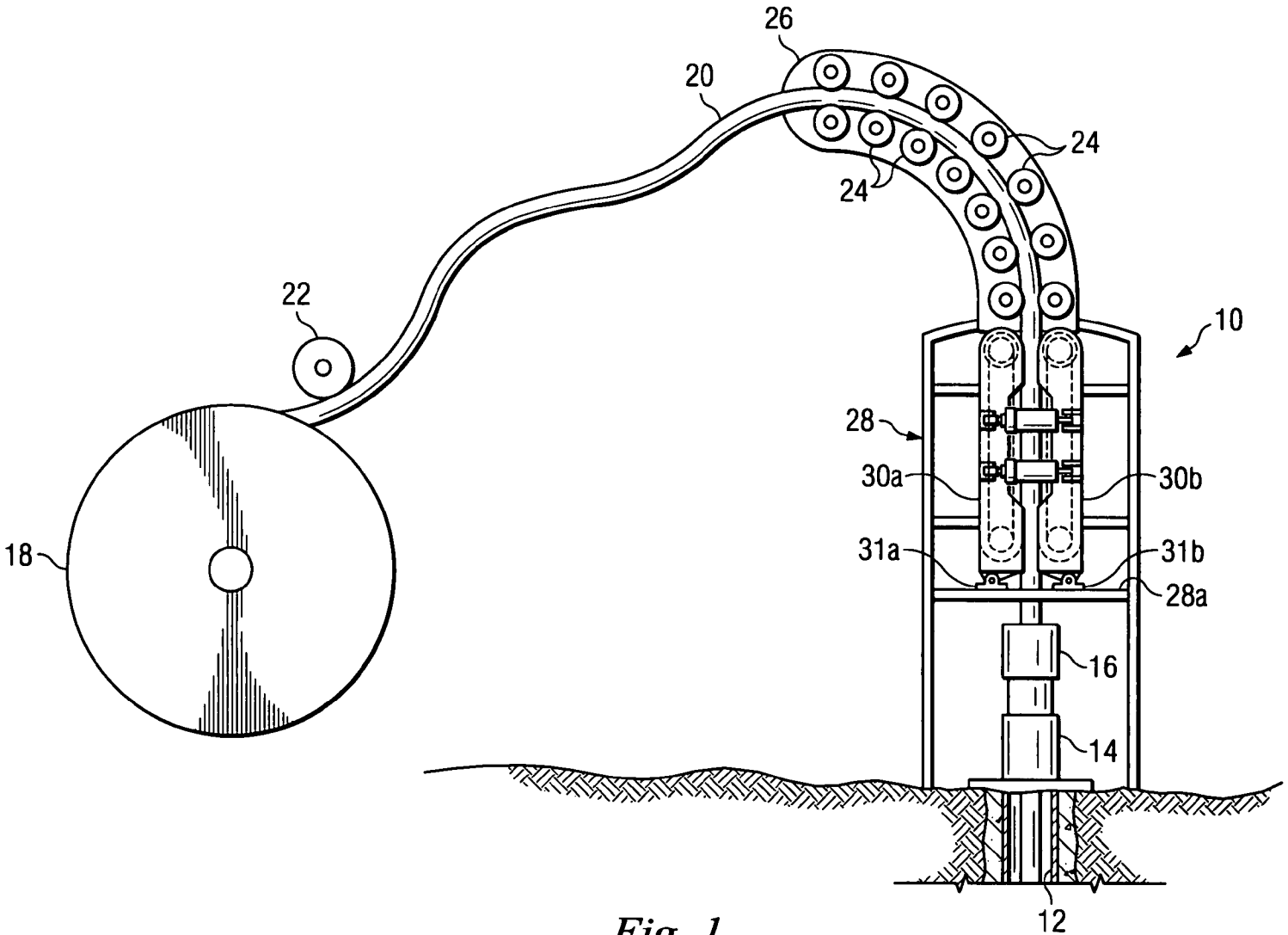
FIG. 1 is a partial elevational/partial sectional view, not necessarily to scale, depicting a coil tubing injector that is controlled by a hydraulic circuit according to an embodiment of the invention.

Referring to FIG. 1, the reference numeral 10 refers, in general, to a coiled tubing injector 10 positioned directly above a well 12. A well-head 14 extends above the well, and a lubricator, or stuffing box 16 extends above the well-head.

A spool of coiled tubing 18 is positioned at a predetermined location away from the injector 10. Unspooled tubing 20 passes from the spool and under a measuring device, such as a wheel 22, and between several (seven in the example of FIG. 1) pairs of opposed rollers 24 rotatably mounted to an arcuate support platform 26. The tubing 20 then passes from the last pair of rollers into the injector 10.

The injector 10 includes a frame 28 having a base 28*a*, and a pair of substantially similar carriages 30*a* and 30*b* mounted on the base via a pair of carrier lugs 31*a* and 31*b*. The carriages 30*a* and 30*b* drive the tubing 20 into the stuffing box 16 for passage through the well-head 14 and into the well 12.

Figure 2:
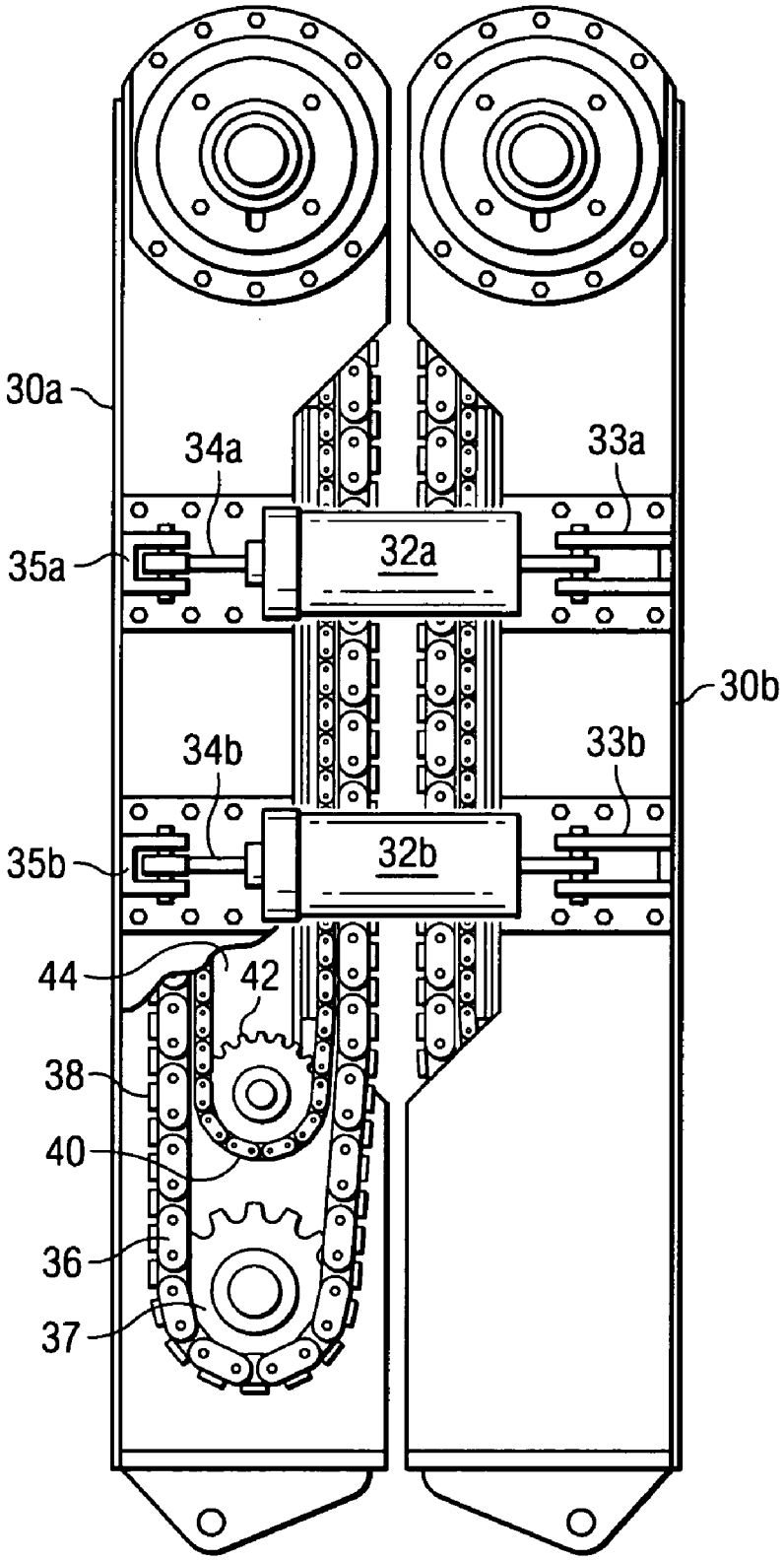
FIG. 2 is an enlarged view of a portion of the injector of FIG. 1.

The carriages 30*a* and 30*b* are depicted in greater detail in FIG. 2, with the remaining structure of the injector 10 and the tubing 20 being removed from view in the interest of clarity. Two hydraulic actuated cylinders 32*a* and 32*b* extend between the carriages 30*a* and 30*b* and are connected to the carriages in any conventional manner. The cylinders 32*a* and 32*b* are connected to the carriage 30*b* by two mounting brackets 33*a* and 33*b*, respectively, and each cylinder 32*a* and 32*b* includes a piston (not shown) that reciprocates in a cylinder housing in response to hydraulic fluid being introduced into, and discharged from, the housing, in a conventional manner.

Two rods 34*a* and 34*b* extend out from the cylinders 32*a* and 32*b*, respectively, with one end of each rod being connected to its corresponding piston and the other end connected to the carriage 30*a* by two mounting brackets 35*a* and 35*b*, respectively. The cylinders 32*a* and 32*b* are connected in a hydraulic circuit (not shown) so that fluid is selectively introduced and discharged from the cylinders to cause corresponding contraction and extension of the cylinders, as will be further described. This contraction and extension of the cylinders 32*a* and 32*b* causes corresponding movement of the carriages 30*a* and 30*b* towards each other to grip the tubing 20, and away from each other to release the tubing. It is understood that two other cylinders (not shown), identical to the cylinders 32*a* and 32*b*, are connected to the carriages 30*a* and 30*b* on the other sides of the carriages.

The carriage 30*a* includes a gripping chain 36 extending between, and engaged with, two spaced sprockets 37 (one of which is shown in FIG. 2). A plurality of gripping elements 38 are mounted to the outer surface of the chain 36 and are adapted to engage and grip the tubing 20 in a conventional manner. A roller chain 40 is also provided that extends within the gripping chain 36 and engages two spaced sprockets 42 (one of which is shown in FIG. 2). Both the roller chain 40 and the gripping chain 36 are disposed around a linear beam 44, shown partially in FIG. 2, and the gripping elements 38 of the gripping chain 36 engage the tubing 20 along substantially the entire length of the beam 44.

The outer surface of the chain 40 is in engagement with the inner surface of the chain 36 and is free wheeling about its sprockets 42. It is understood that a motor (not shown) is provided to drive at least one of the sprockets 37, and therefore the chain 36. The engagement between the chains 36 and 40 is such that the chain 36 drives the chain 40 which functions to support the chain 36.

Since the carriage 30*b* is identical to the carriage 30*a* the above components of the carriage 30*a* will be referred to by the same reference numerals in connection with the carriage 30*b*.

During the general operation, and referring to FIGS. 1 and 2, the tubing 20 is unspooled from the spool 18 and passes through the rollers 24 where it is straightened before it enters the injector 10. The cylinders 32*a* and 32*b* are normally in their extended positions and are actuated via the above-mentioned hydraulic circuit to force them to their retracted position and therefore pull the carriages 30*a* and 30*b* towards each other until the gripping elements 38 on the gripping chain 36 engage the tubing 20 at a predetermined loading. The above-mentioned motors are then activated to drive the sprocket 37 and the gripping chain 36, which, in turn drives the roller chain 40. It is understood that the carriage 30*b* functions in the same manner as the carriage 30*a* so that the gripping chain 36 on the carriage 30*b* engages the tubing 20 from a diametrically opposite direction with a predetermined load, or force. As a result, the tubing 20 is driven into the well 12.

Figure 3:
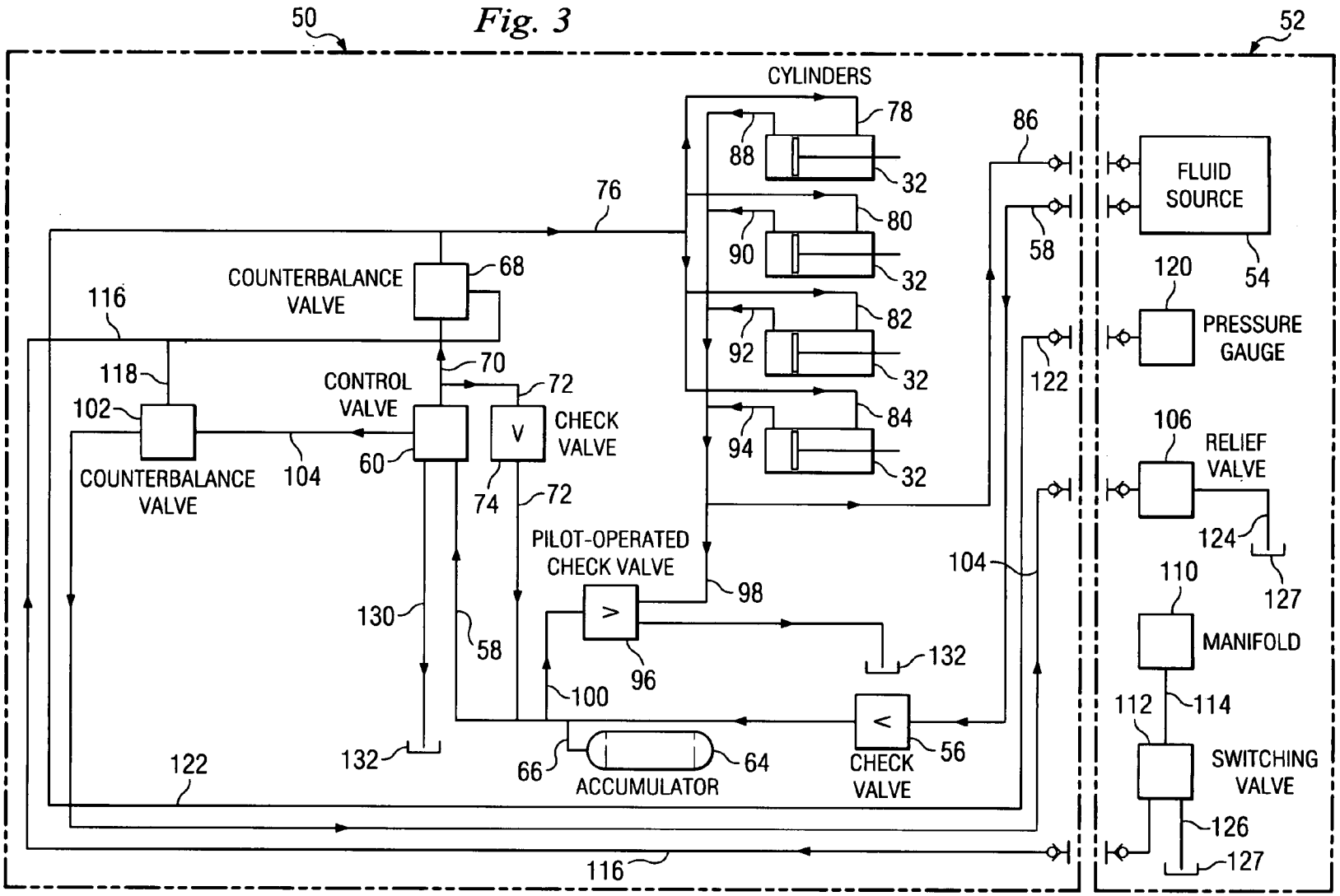
FIG. 3 is a diagrammatic view depicting the hydraulic circuit for controlling the injector, according to an embodiment of the invention.

Referring to FIG. 3, a hydraulic circuit is shown that operates the carriages 30*a* and 30*b* (FIG. 2) in the above manner, and is generally referred to by the reference numeral 50. A control circuit 52 is also provided for controlling the circuit 50 and includes several components that are in fluid communication with various components in the circuit 50, as will be explained.

The control circuit 52 includes a source 54 of pressurized hydraulic fluid which is connected to a check valve 56 in the circuit 50 via a hydraulic work line 58 that also extends from the check valve to the input of a control valve 60 in the circuit 50. The check valve 56 permits fluid flow in a direction indicated by the flow arrows, but prevents flow in the opposite direction. An accumulator 64 is connected to the line 58 between the check valve 56 and the control valve 60 via a line 66. The accumulator 64 is adapted to store fluid from the circuit 50 and introduce the stored fluid into the circuit under conditions to be described.

An output from the valve 60 is connected to a counterbalance valve 68 via a hydraulic work line 70. The valve 68 is normally closed but can be opened under conditions to be described. A hydraulic work line 72 extends from the line 58 at a location downstream of the valve 60 to a check valve 74 and, from the latter valve, to the line 58 at a location upstream of the valve 60. The check valve 74 permits fluid flow in a direction indicated by the flow arrows, but prevents flow in the opposite direction. It is understood that the valve 60 includes a relief mechanism (not shown) and its function will be described in detail.

The counterbalance valve 68 is also connected to a work line 76 which, in turn, is connected to one end portion of each cylinder 32 via a plurality of branch lines 78, 80, 82 and 84. Thus, fluid flows from the source 54, through the valves 56, 60, and 68 and to the cylinders 32 for actuating the cylinders in a manner to be described. It is understood that the valve 68 includes a check valve that will permit fluid flow in this manner but will prevent fluid flow in the opposite direction.

The fluid source 54 is also connected to the injector hydraulic circuit 50 via a hydraulic work line 86 which, in turn, is connected to the other end portion of each cylinder 32 via a plurality of branch lines 88, 90, 92 and 94 to enable fluid to flow from the cylinders back to the source in a direction indicated by the flow arrows.

The line 86 is also connected to a pilot-operated check valve 96, via a pilot line 98, and the check valve 96 is, in turn, connected to the line 58 via a hydraulic work line 100. The check valve 96 normally prevents flow through the line 100 and is adapted to open when fluid is received from the pilot line 98 to permit flow in the direction indicated by the flow arrows under conditions to be described. It is understood that fluid flow between the source 54 and the lines 58 and 86 can be selectively and remotely controlled by an operator in any conventional manner.

An output from the valve 60 is also connected to a counterbalance valve 102 via a pilot line 104 which extends to a relief valve 106 located in the control circuit 52. The valve 102 is normally closed but is opened under conditions to be described, and the valve 106 is adjustable to control the pressure reduction across the valve 60, from the line 58 to the line 70. The valve 60 is configured to allow some fluid to pass through it from the line 58 to the line 70, while allowing some fluid to be diverted, or bled off, from the valve to the line 104 and the valve 102, for passage to the relief valve 106, all under conditions to be described.

A manifold 110 is provided in the control circuit 52 and is connected to a switching valve 112 via a line 114. Although not shown in the drawings in the interest of clarity, it is understood that the manifold 110 receives fluid from the source 54. The switching valve 112 is connected to the counterbalance valves 68 and 102 in the injector hydraulic circuit 50 via lines 116 and 118, respectively which act as pilot lines for the counterbalance valves and, as such, control the operation of the valves.

A pressure gauge 120 is also provided in the control circuit 52 and is connected to the line 76 in the circuit 50 via a line 122. Thus, the pressure gauge 120 can measure pressure in the line 76 and therefore the pressure in the cylinders 32. The relief valve 106 and the switching valve 112 are connected, via a line 124 and a line 126, respectively, to a return manifold, or tank, 127. The switching valve 112 normally connects the line 116 to the manifold 110 via the line 114, but is adapted to be switched to terminate this connection and connect the line 116 to the tank 127 via the line 126, under conditions to be described.

In the circuit 50, the check valve 96 and the control valve 60 are connected, via the line 100 and a line 130, respectively, to a tank 132. Thus fluid can be discharged from the valves 60 and 96 into the tank 132 under conditions to be described.

The counterbalance valves 68 and 102 are normally closed, but are adapted to open in response to a predetermined fluid pressure being applied to the valves by the lines 116 and 118, respectively. When the valve 68 is in its open position, fluid is allowed to flow from upstream of the valve 60, through the valves 60 and 68, and to the cylinders 32 as indicated by the flow arrows. Fluid is also allowed to flow in the reverse direction from the cylinders 32, through the valve 68 and to the tank 132, either via the control valve 60 or via the check valves 74 and 96 in a manner to be described. When the valve 68 is in its closed position, fluid is still allowed to flow from upstream of the valve 60 to the cylinders 32 via the valve 60 and the check valve included in the valve 68. However, reverse fluid flow from the cylinders 32 to the tank 132 via the valve 68 is not allowed when the valve 68 is in its closed position. When the valve 102 is in its open position, fluid is allowed to flow from the valve 60 to the valve 106 as indicated by the flow arrows. When the valve 102 is in its closed position, fluid is not allowed to flow from the valve 60 to the valve 106. Reverse fluid flow through the valve 102, that is, fluid flow from the valve 106 to the valve 60, is not possible, regardless of whether the valve 102 is in its open or closed position.

Assuming that the tubing 20 (FIGS. 1 and 2) is passed into the injector 10 in the manner discussed above and it is desired to close the carriages 30*a* and 30*b* by retracting the cylinders 32, so that the carriages grip the tubing 20 for the purpose of advancing it into the well 12, an appropriate valve, pump or the like (not shown), associated with the fluid source 54 is activated. Thus, pressurized fluid flows into the line 58 and thus pressurizes that portion of the line extending to the valve 60 to a pressure that corresponds to the maximum gripping pressure that the carriages 30*a* and 30*b* may exert on the tubing 20. The valve 60 is set to pass a portion of this fluid to the cylinders 32 in the manner discussed above, which portion is sufficient to establish a normal operating fluid pressure in the cylinders 32 that corresponds to the normal-operating gripping pressure that is to be exerted by the carriages 30*a* and 30*b* on the tubing 20. The remaining portion of the fluid from the valve 60 will bleed off and pass through the pilot line 104, the counterbalance valve 102, and to the relief valve 106.

Fluid also flows from the source 54 to the manifold 110 in the control circuit 52 and pressurizes the manifold to a pressure that also corresponds to the maximum gripping pressure of the carriages 30*a* and 30*b*. Assuming that the switching valve 112 is in its normal mode in which it connects the manifold 110 to the line 116, fluid flows from the manifold 110, through the valve 112, and to the lines 116 and 118 to pressurize the lines. The counterbalance valves 68 and 102 are normally closed and, the lines 116 and 118, respectively serve as a pilot line for the valves and thus open the valves and allow pressure to be transmitted through the valves.

The output pressure from the valve 60 is transmitted to one end of each of the cylinders 32 via the lines 70,76, 78, 80, 82 and 84. Assuming that the rods of the cylinders 32 are in an extended position as a result of a previous operation, the rods will retract to the positions shown in FIG. 3 when subjected to this pressure, thus moving the carriages 30*a* and 30*b* (FIGS. 1 and 2) towards each other to grip the tubing 20. This retraction of the cylinders 32 will force fluid from the other end of each of the cylinders to the lines 88, 90, 92 and 94, and from the latter lines back to the fluid source 54 via the line 86 in a direction shown by the flow arrows.

Due to the opening of the counterbalance valve 102, some of the fluid from the valve 60 will bleed off and pass through the pilot line 104, the counterbalance valve 102, and to the relief valve 106. The valve 60 and the relief valve 106 are designed so that the relief valve can control the amount of flow that can be bled off from the valve 60 in the above manner, and therefore the fluid pressure passing to the cylinders 32. In particular, to increase the amount of force on the tubing 20, the relief valve 106 is adjusted to reduce the amount of flow being bled off from the valve 60, thereby increasing the output pressure in the line 70. To decrease the amount of force on the tubing 20, the relief valve 106 is adjusted to increase the amount of flow being bled off from the control valve 60, thereby decreasing the output pressure in the line 70.

When the fluid applied to the cylinders 32 is at the desired pressure corresponding to the desired pressure, or load, that the carriages 30*a* and 30*b* exert on the tubing 20, the relief valve 106 is no longer adjusted and the output pressure in the line 70 remains constant, thereby applying constant loading on the tubing 20. In each of the above modes, the pressure applied to the cylinders 32 can be measured using the gauge 120.

In situations where the tubing 20 is part of a string having a varying diameter, constant pressure on the cylinders 32 can always be maintained despite the fact that the diameter of the tubing varies as it passes through the injector 20. Specifically, if the diameter of the tubing 20 increases during the above mode, it causes a corresponding extension of the cylinders 32 from the retracted position of FIG. 3. However, an unsafe increase in pressure in the cylinders 32 is avoided because the hydraulic fluid in the cylinders will be forced out of the cylinders 32 and flow to the control valve 60 through the lines 78-84, the line 76, the valve 68 and the line 70 in a direction opposite that shown by the arrows in FIG. 3. This reverse fluid flow through the valve 68 is possible because the valve 68 is still open due to the fluid pressure being applied to the valve 68 by the line 116. This reverse fluid flow triggers the above-mentioned relief mechanism in the control valve 60 in a conventional manner, enabling hydraulic fluid to flow from the valve 60 to the tank 132 via the line 130. Thus, only as much hydraulic fluid as necessary flows from the cylinders 32 to the tank 132 in order to maintain constant pressure on the tubing 20.

If the diameter of the tubing 20 decreases, additional hydraulic fluid will enter the cylinders 32 from the fluid source 54 via the valve 60 in the manner described above, thereby maintaining constant pressure on the cylinders 32. Assuming that the carriages 30*a* and 30*b* are gripping the tubing 20 in accordance with the foregoing, if there is a significant loss in the fluid pressure available from the source 54 for whatever reason, the pressure levels in the line 58 and the line 116, which are both normally at the maximum gripping fluid pressure discussed above, will drop significantly. When this occurs, there is no immediate effect on the pressure in the line 58 or the accumulator 64 since the check valve 56 maintains the maximum gripping fluid pressure downstream from its location in the line 58. Likewise, the closed check valve 96 prevents fluid from flowing from the line 58 to the tank 132 via the line 100, thereby holding the pressure level in the line 58 downstream of the check valve 56 at the maximum gripping pressure.

In response to any significant loss in the fluid pressure available from the source 54, the pressure at the manifold 110 also drops since the manifold is supplied with fluid from the source 54. Thus, the pressure in the line 116 is lowered accordingly. Since the line 116 serves as the pilot line for the counterbalance valve 68, this pressure drop causes the counterbalance valve 68 to close, thereby holding the gripping pressure in the cylinders 32. Similarly, the pressure drop in the line 116 causes a pressure drop in the pilot line 118, thus causing the counterbalance valve 102 to close and prevent fluid from being bled off from the valve 60 via the pilot line 104.

Also in response to the above significant loss in the fluid pressure available from the source 54, the normal operating pressure placed on the cylinders 32 will not only be maintained as discussed above, but the pressure on the cylinders 32 will be increased for safety purposes. In particular, the output pressure of the control valve 60, and therefore the pressure on the cylinders 32, will increase because the pressure in the line 58 downstream of the check valve 56 is higher than the pressure in the line 70 and fluid can no longer be bled off from the control valve 60 via the pilot line 104, as discussed above. This pressure increase is possible due to the fact that the above-mentioned check valve included in the counterbalance valve 68 will allow pressure to be transmitted to the cylinders 32, but will prevent pressure to be transmitted in the opposite direction from the cylinders 32, even though the counterbalance valve 68 is closed. Also, additional fluid provided to the line 58 by the accumulator 64 will be transmitted to the cylinders 32 through the valve 60, the check valve included in the counterbalance valve 68, and the lines 58, 70, 76, 78, 80, 82 and 84, to place additional pressure on the cylinders. Thus, the cessation of pressure bleeding from the control valve 60 and the additional pressure provided by the accumulator 64 will result in the gripping pressure provided by the cylinders 32 rising to a value that is significantly higher than the normal operating gripping pressure.

When the full fluid pressure in the source 54 is restored, the counterbalance valves 68 and 102 will automatically open again, allowing pressure to be bled off from the valve 60, thereby reducing the pressure to the cylinders 32. The gripping pressure will then be able to be controlled as usual by the relief valve 106. Thus, an operator does not have to leave the control circuit 52 to restart normal injector hydraulic circuit 50 control and operation.

The circuits 50 and 52 are also adapted to operate in an emergency mode in the event it is desired to terminate the normal operation of the injector 10 for some unforeseen reason. In this case an operator would manually switch the switching valve 112 so that the above-mentioned connection between the line 116 and the manifold 110 is terminated and a connection is established between the line 116 and the tank 127 via the line 126, as discussed above. Thus fluid in the line 116 is passed to the tank 127 resulting in a significant pressure drop in the line 116, similar to the pressure drop experienced when the fluid pressure at the source 54 is lost as discussed above.

When the pressure in the line 116 drops, the counterbalance valve 68 closes, thus holding the gripping pressure in the cylinders 32. Similarly, the counterbalance valve 102 closes due to the drop in pressure in the line 116 and therefore the line 118, thus preventing pressure from being bled off from the control valve 60. As a result, the pressure at the valve 60, and therefore the pressure in the line 70, increases and is transmitted to the cylinders 32 via the check valve included in the closed counterbalance valve 68, as discussed above, and the lines 76, 78, 80, 82 and 84. The output pressure will increase all the way up to the maximum gripping pressure since the fluid source 54 is still providing maximum gripping pressure to the injector hydraulic circuit 50 via the line 58. Thus, the accumulator 64 does not have to provide additional pressure to the cylinders 32 as in the previous mode. The output pressure of the control valve 60, and therefore the pressure placed on the cylinders 32, ceases to increase and remains constant after reaching the maximum gripping pressure.

The cylinders 32 will remain at the maximum gripping pressure until the operator manually switches the switching valve 112 to connect the line 116 back to the manifold 110 upon resolution of the emergency situation. When this occurs, the pressure in the line 116 will increase back up to the maximum gripping pressure, resulting in the opening of the counterbalance valves 68 and 102. This allows the resumption of pressure bleeding from the control valve 60, thereby decreasing the pressure placed on the cylinders 32 via the open counterbalance valve 68. The operator may then control the gripping pressure using the relief valve 106, as described above.

When it is desired to open the carriages 30*a* and 30*b* (FIGS. 1 and 2) to release the tubing 20, the cylinders 32 are moved from their retracted positions discussed above to their extended position. Thus, the carriages 30*a* and 30*b* move away from each other and the gripping elements 38 on the gripping chains 34 release the tubing 20.

To achieve this opening action, the fluid source 54 is activated and pressurized fluid is applied to the line 86 by a proper valve, switch, or the like. This results in fluid flowing to the cylinders 32 via the lines 88, 90, 92 and 94, in a direction opposite the flow arrows shown in FIG. 3, causing the cylinders to extend. The extension of the cylinders 32 forces fluid out of the cylinders 32, into the lines 78, 80, 82, and 84 and through the line 76, the valves 68 and 72 and to the line 58, also in a direction opposite the direction of the flow arrows. Fluid is allowed to flow through the counterbalance valve 68 since the line 116 is still pressurized at the maximum gripping pressure, which maintains the valve in its open position. Also, although fluid will not flow from the line 70 to the line 58 through the control valve 60, fluid will flow from the line 70 into the line 72 and to the check valve 74. Since the pressure in the line 70 is greater than the pressure in the line 58, the check valve 74 will open causing the fluid to flow, via the line 72 to the line 58. The pressurization of the line 86 also results in the pressurization of the pilot line 98, which opens the pilot-operated check valve 96 to allow hydraulic fluid to flow from the lines 72 and 58, through the line 100 and to the tank 132. As a result, the fluid discharging from the cylinders 32 is allowed to drain to the tank 132.

During this cylinder open mode, the counterbalance valve 102 remains open because the line 116 is still pressurized at the maximum gripping pressure as discussed above. However, pressure is not bled off from the control valve 60 to the valve 102 since the pressure in the line 70 is greater than the pressure in the line 58 and therefore the counterbalance valve 102 is not employed.

Figure 4A:
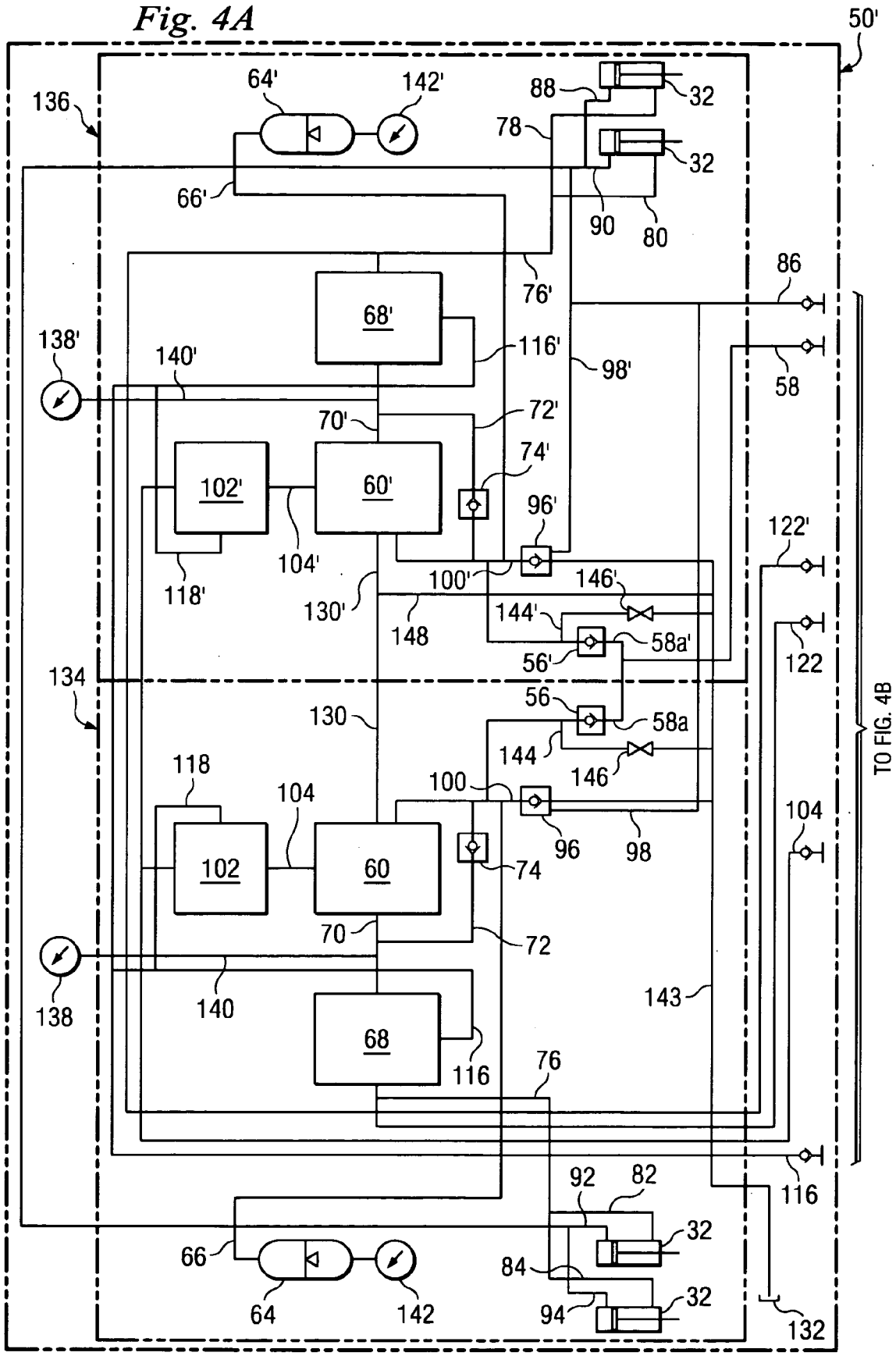
FIGS. 4*a*–4*b* are diagrammatic views depicting a hydraulic circuit according to another embodiment of the invention.
Figure 4B:
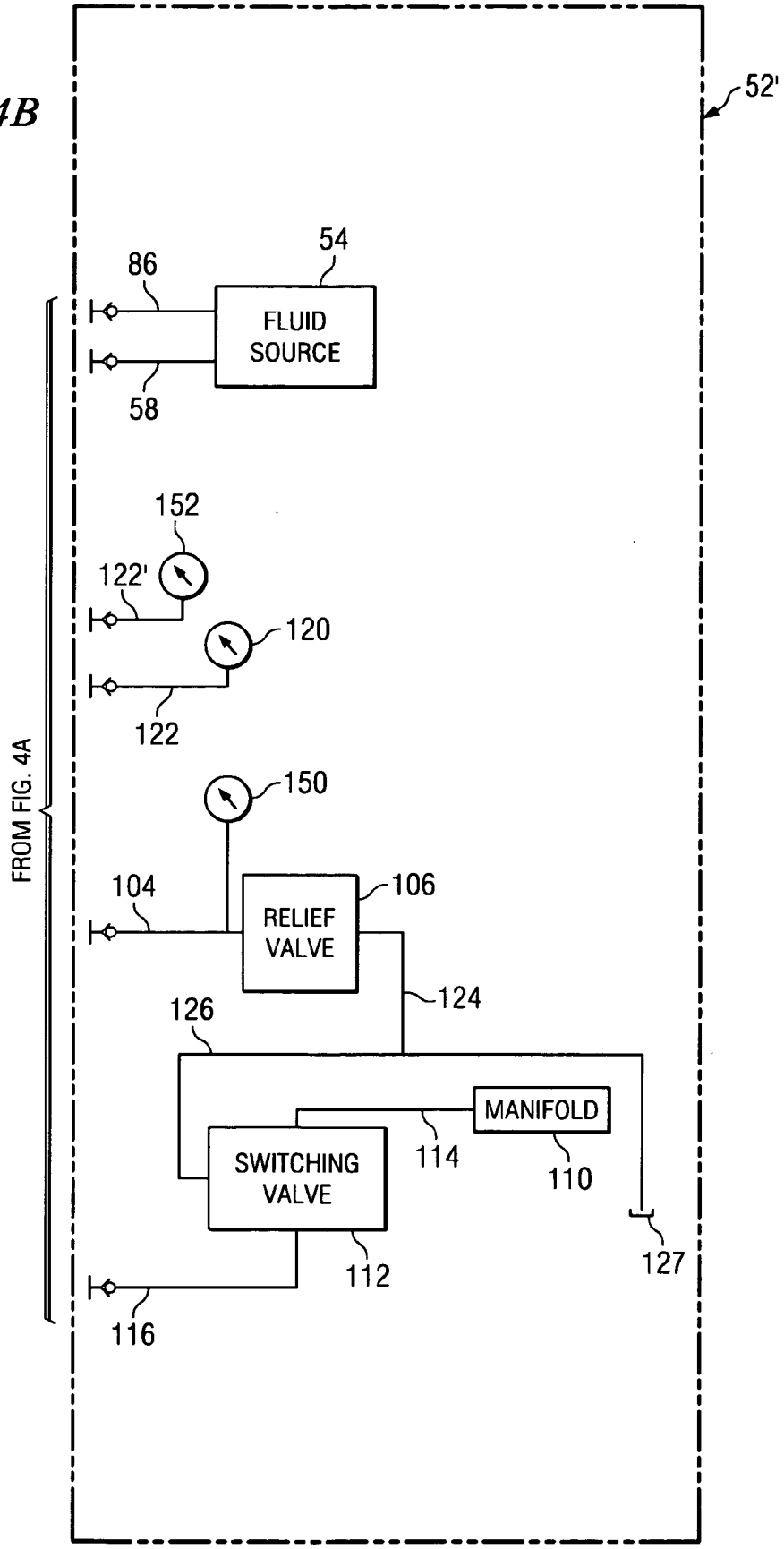

The embodiment of FIGS. 4A and 4B includes components of the embodiment of FIG. 3, which components are given the same reference numerals. In this embodiment, and referring to FIG. 4A, an injector hydraulic circuit 50' is provided which comprises a pair of substantially symmetric hydraulic sub-circuits 134, 136. The sub-circuit 134 is essentially the same as the circuit 50 of the embodiment of FIG. 3 with the exception that there are two cylinders 32 in sub-circuit 134 rather than four. Thus, the line 76 is connected to the two cylinders 32 via the lines 82 and 84 and the line 86 is connected to the two cylinders 32 via the lines 92 and 94. Also, the sub-circuit 134 includes a gauge 138 connected to the line 70 via a line 140, and a gauge 142 connected to the accumulator 64. The line 100 is connected to the tank 132 via a line 143. A line 144 is provided that connects the line 56 to the line 143 which, in turn, is connected to the tank 132, and a manual open/close valve 146 is connected in the line 144. A line 148 connects the line 130 to the line 143 which, in turn, is connected to the tank 132.

The sub-circuit 136 is substantially the symmetric equivalent of the sub-circuit 134, containing the same components that are found in the sub-circuit 134, which are given the same reference numerals with prime designations. Thus, the line 76' is connected to the two cylinders 32 associated with the circuit 136 via the lines 82' and 84' and the line 86' is connected to the two cylinders 32 via the lines 92' and 94'. Also, the sub-circuit 134' includes a gauge 138' connected to the line 70 via a line 140', and a gauge 142' connected to the accumulator 64'. The line 100' is connected to the tank 132 via the line 143. A line 144' is provided that connects the line 56' to the line 143 which, in turn, is connected to the tank 132, and a manual open/close valve 146' is connected in the line 144'. The line 148 connects the line 130' to the line 143 which, in turn, is connected to the tank 132. The sub-circuits 134, 136 are connected to the line 58 by two branches 58*a* and 58*a'* which, in turn, are connected to the check valves 56 and 56', respectively.

The control circuit 52' shown in FIG. 4B is similar to the control circuit 52 in the previous embodiment with the exception that a gauge 150 is connected to the line 104 upstream of the relief valve 106, and a gauge 152 is connected to the line 122' in the sub-circuit 136.

In operation of the embodiment of FIGS. 4A and 4B, the sub-circuits 134 and 136 of the circuit 50' operate in the same manner as the circuit 50 of the embodiment of FIG. 3, except that each sub-circuit provides pressure to two cylinders 32 instead of four. In this context, the pressure from the line 58 is equally applied via the branch lines 58*a* and 58*a'* so that half of the pressure is transmitted to the sub-circuit 134 and the other half is transmitted to the sub-circuit 136.

Thus, the total force applied to the tubing 20 by the cylinders 32 remains the same as in the embodiment of FIG. 3. Also, one set of controls in the control circuit 52' controls both of the sub-circuits 134 and 136 and the relief valve 106 controls the sum of the output pressures in the lines 70 and 70', thereby controlling the total amount of pressure placed on all four cylinders 32.

The gauges 138, 138' are used for troubleshooting purposes and measure the output pressures of the control valves 60, 60' in the lines 70, 70', respectively. The gauges 142, 142' measure the pre-charge pressure of the accumulators 64, 64', respectively, and the manual open/close valves 146, 146' may be used to drain the hydraulic circuit 50 of its fluid, draining the fluid to the tank 132 via the lines 144, 144', respectively, and via the line 143.

In the control circuit 52', the gauge 150 measures the approximate sum of the pressure in the lines 70 and 70', respectively, that is, the output pressure from the control valves 60 and 60', respectively. The pressure gauge 120 measures the pressure being applied only to the two cylinders 32 associated with the sub-circuit 134 while the gauge 152 measures the pressure being applied to the two cylinders 32 associated with the sub-circuit 136.

The operation of the embodiment of FIGS. 4A and 4B is essentially the same as described above in connection with the embodiment of FIGS. 1–3, with the substantially symmetric configuration provided by the sub-circuits 134 and 136 providing for 50% redundancy for safety purposes. For example, if during normal operation of the injector 10 the line 76 in the sub-circuit 134 breaks, or fails, and hydraulic fluid leaks out, the pressure in the two cylinders 32 associated with the sub-circuit 134 will drop significantly, reducing the force being applied to the tubing 20 by approximately 50%. Similarly, if during normal operation of the injector 10 the line 76' in the sub-circuit 136 breaks and hydraulic fluid leaks out, the pressure in the two cylinders 32 associated with the sub-circuit 136 will drop significantly, reducing the force being applied to the tubing 20 by approximately 50%. In each scenario 50% of the force on the tubing is maintained. Variations It is understood that variations may be made in the foregoing without departing from the scope of the invention. For example, although four cylinders 32 are used in the injector 10 and the injector hydraulic circuits 50 and 50', the quantity of cylinders 32 may vary as long as an evenly distributed load is applied to the tubing 20 via the gripping elements 38. For the embodiment of FIG. 3, the quantity of cylinders 32 may vary from one to an unlimited number. For the embodiment of FIGS. 4A and 4B, the quantity of cylinders 32 may vary from two to an unlimited number.

Further, in addition to the injector 10, other configurations and/or types of injectors for injecting coiled tubing may be employed in conjunction with the injector hydraulic circuit 50 or 50', as long as the injector types include hydraulic actuated cylinders.

Still further, the number of sub-circuits in the embodiment of FIGS. 4A and 4B may be increased to an unlimited number. Also, other types of valves may be substituted for the valves employed in the exemplary embodiments. For example, a pilot-operated check valve may be substituted for each counterbalance valve employed in the exemplary embodiments.

Still further, one or more embodiments of FIG. 3 may be employed in conjunction with the injector 10 or with other types of injectors that include hydraulic actuated cylinders, and each circuit 50 of each embodiment may be independently controlled using the corresponding circuit 52 of each embodiment. Also, one or more embodiments of FIGS. 4A and 4B may be employed in conjunction with the injector 10 or with other types of injectors that include hydraulic actuated cylinders, and each circuit 50' of each embodiment may be independently controlled using the corresponding circuit 52' of each embodiment.

Any foregoing spatial references, such as "side," "above," etc., are for the purpose of illustration only and do not limit the specific spatial orientation of the structure described above.

Although only two exemplary embodiments of this invention have been described in detail above, those skilled in the art will readily appreciate that many other variations and modifications are possible in the exemplary embodiments without materially departing from the novel teachings and advantages of this invention. Accordingly, all such variations and modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A hydraulic circuit for controlling at least one hydraulically operated device, comprising:

a source of fluid;

a first valve;

a second valve for receiving the fluid from the source and passing at least a portion of the fluid to the device while selectively allowing some of the fluid to pass to the first valve;

wherein the first valve is adjustable to control the amount of fluid that it receives from the second valve and therefore control the amount of fluid passed from the second valve to the device; and a third valve connected between the second valve and the device and movable from an open position in which reverse fluid flow from the device and through the third valve is permitted, and to a closed position in which the reverse fluid flow from the device and through the third valve is prevented.

2. The circuit of claim 1 wherein the third valve is connected to the source, and moves to its open position when fluid is received from the source and to its closed position when fluid flow from the source is terminated.

3. The circuit of claim 2 further comprising a flow line connecting the source to the second valve, and wherein the second valve and the third valve allow fluid in the line to pass to the device upon termination of fluid flow from the source and closing of the third valve.

4. The circuit of claim 2 further comprising an additional source of fluid connected to the second valve which passes fluid to the device upon termination of fluid flow from the source and closing of the third valve.

5. The circuit of claim 1 further comprising a pilot line for flowing fluid from the source to the third valve to control its movement between the open and closed position.

6. The circuit of claim 5 further comprising a switching member connected to the pilot line and adapted to manually switch fluid flow between the source and the pilot line to a fluid flow between the pilot line to an exhaust tank to close the third valve and prevent fluid flow from the second valve to the first valve.

7. The circuit of claim 6 further comprising a manifold connected between the source and the switching member for supplying fluid to the pilot line.

8. The circuit of claim 1 wherein the device is a hydraulic cylinder that retracts upon receiving the fluid to apply a load to an external member.

9. The circuit of claim 8 wherein the first valve controls the amount of the load applied by the cylinder to the external member.

10. The circuit of claim 1 further comprising an additional source of fluid connected between the first-mentioned source and the second valve for supplying the additional fluid to the device in response to termination of fluid flow from the first-mentioned source.

11. A hydraulic circuit for controlling at least one hydraulically operated device, comprising:

a source of fluid;

a first valve;

a second valve for receiving the fluid from the source and passing at least a portion of the fluid to the device while selectively allowing some of the fluid to pass to the first valve;

wherein the first valve is adjustable to control the amount of fluid that it receives from the second valve and therefore control the amount of fluid passed from the second valve to the device; and a third valve connected between the second valve and the first valve and movable from an open position in which the fluid flow from the second valve to the first valve is permitted, and to a closed position in which the fluid flow from the second valve to the first valve is prevented.

12. The circuit of claim 11 wherein the third valve is connected to the source, and moves to its open position when fluid is received from the source and to its closed position in response to the termination of fluid flow from the source.

13. A hydraulic circuit for controlling at least one hydraulically operated cylinder that retracts upon receiving fluid to apply a load to a section of tubing that moves relative to the cylinder as the cylinder applies the load, the circuit comprising:

a source of the fluid;

a first valve; and second valve for receiving the fluid from the source and passing at least a portion of the fluid to the device while selectively allowing some of the fluid to pass to the first valve;

wherein the first valve is adjustable to control the amount of fluid that it receives from the second valve and therefore control the amount of fluid passed from the second valve to the cylinder;

the cylinder adapted to discharge the fluid when the diameter of the tubing increases from a predetermined value, and the second valve having a relief mechanism to permit the amount of the load to remain constant.

14. The circuit of claim 13 wherein the cylinder is adapted to receive additional fluid to permit the amount of the load to remain constant when the diameter of the tubing decreases from a predetermined value.

15. The circuit of claim 13 further comprising two carriages respectively operated by the cylinder and adapted to engage the tubing to advance the tubing between the carriages.

16. A hydraulic circuit for controlling at least one hydraulically operated cylinder that retracts upon receiving fluid to apply a load to an external member, the circuit comprising:

a source of the fluid;

a first valve;

a second valve for receiving the fluid from the source and passing at least a portion of the fluid to the device while selectively allowing some of the fluid to pass to the first valve;

the first valve being adjustable to control the amount of fluid that it receives from the second valve and therefore control the amount of fluid passed from the second valve to the cylinder, wherein the cylinder receives fluid at one portion of the cylinder to cause the cylinder to retract; and a line for connecting the source to another portion of the cylinder to cause extension of the cylinder and reduction of the load on the external member.

17. The circuit of claim 16 wherein, during the extension of the cylinder, fluid flows from the cylinder to the fluid source.

18. The circuit of claim 16 wherein there are at least two cylinders adapted to apply oppositely directed loads to the external member.

19. The circuit of claim 18 wherein the second valve is connected to each of the cylinders.

20. A hydraulic circuit for controlling at least two hydraulically operated devices, comprising:

a source of fluid;

a first valve;

a second valve for receiving fluid from the source and passing at least a portion of the fluid to at least one of the devices while selectively allowing some of the fluid to pass to the first valve; and a third valve for receiving fluid from the source and passing at least a portion of the fluid to at least one other of the devices while selectively allowing some of the fluid to pass to the first valve;

wherein the first valve is adjustable to control the amount of fluid that it receives from the second and third valves and therefore control the amount of fluid passed from the second and third valves to the devices.

21. The circuit of claim 20 further comprising a fourth valve connected between the second valve and the at least one device and movable from an open position in which reverse fluid flow from the at least one device and through the fourth valve is permitted, and to a closed position in which the reverse fluid flow from the at least one device and through the fourth valve is prevented.

22. The circuit of claim 21 further comprising a fifth valve connected between the third valve and the at least one other device and movable from an open position in which reverse fluid flow from the at least one other device and through the fifth valve is permitted, and to a closed position in which the reverse fluid flow from the at least one other device and through the fifth valve is prevented.

23. The circuit of claim 22 wherein each of the fourth and fifth valves is connected to the source, and moves to its open position when fluid is received from the source and to its closed position when fluid flow from the source is terminated.

24. The circuit of claim 23 further comprising a flow line connecting the source to each of the second and third valves, and wherein the second and third valves and the fourth and fifth valves are adapted to allow fluid in the line to pass to the devices upon termination of fluid flow from the source and closing of the fourth and fifth valves.

25. The circuit of claim 23 further comprising an additional source of fluid connected to each of the second and third valves which passes fluid to at least one device upon termination of fluid flow from the source.

26. The circuit of claim 22 further comprising a pilot line for flowing fluid from the source to each of the fourth and fifth valves to control its movement between the open and closed position.

27. The circuit of claim 26 further comprising a switching member connected to the pilot line and adapted to manually switch fluid flow between the source and the pilot line to a fluid flow between the pilot line to an exhaust tank to close the fourth and fifth valves and prevent fluid flow from the second and third valves to the first valve.

28. The circuit of claim 27 further comprising a manifold connected between the source and the switching member for supplying fluid to the pilot line.

29. The circuit of claim 20 further comprising:

a fourth valve connected between the second valve and the first valve and movable from an open position in which the fluid flow from the second valve to the first valve is permitted, and to a closed position in which the fluid flow from the second valve to the first valve is prevented; and a fifth valve connected between the third valve and the first valve and movable from an open position in which the fluid flow from the third valve to the first valve is permitted, and to a closed position in which the fluid flow from the third valve to the first valve is prevented.

30. The circuit of claim 29 wherein each of the fourth and fifth valves is connected to the source, and moves to its open position when fluid is received from the source and to its closed position in response to the termination of fluid flow from the source.

31. The circuit of claim 20 wherein each device is a hydraulic cylinder that retracts upon receiving the fluid to apply a load to an external member.

32. The circuit of claim 31 wherein the first valve controls the amount of the load applied by each cylinder to the external member.

33. The circuit of claim 31 wherein the external member is a section of tubing that moves relative to each cylinder as the cylinders apply the load, each cylinder adapted to discharge the fluid when the diameter of the tubing increases from a predetermined value, each of the second and third valves having a relief mechanism to permit the amount of the load to remain constant.

34. The circuit of claim 33 further comprising two carriages respectively operated by the cylinders and adapted to engage the tubing to advance the tubing between the carriages.

35. The circuit of claim 31 wherein the external member is a section of tubing that moves relative to each cylinder as the cylinders apply the load, each cylinder adapted to receive additional fluid to permit the amount of the load to remain constant when the diameter of the tubing decreases from a predetermined value.

36. The circuit of claim 31 wherein each cylinder receives fluid at one portion of the cylinder to cause the cylinder to retract, and further comprising a line for connecting the source to another end portion of each cylinder to cause extension of the cylinder and reduction of the load on the external member.

37. The circuit of claim 36 wherein, during the extension of each cylinder, fluid flows from each cylinder to the source.

38. The circuit of claim 31 wherein there are least four cylinders adapted to apply oppositely directed loads to the external member.

39. The circuit of claim 38 wherein the second valve is connected to at least two cylinders and wherein the third valve is connected to at least two additional cylinders.

40. The circuit of claim 20 further comprising an additional source of fluid connected between the first-mentioned source and the second and third valves for supplying the additional fluid to the devices in response to termination of fluid flow from the first-mentioned source.

41. A method for controlling at least one hydraulically operated device, comprising:

passing fluid from a source to the device while selectively allowing another portion of the fluid from the source to pass to a first valve;

adjusting the first valve to control the amount of fluid passed to the first valve and therefore the amount of fluid passed to the device;

passing the flow from the source through a second valve for passing to the device and to the first valve, connecting a third valve between the second valve and the device, and moving the third valve from an open position in which reverse fluid flow from the device and through the third valve is permitted, and to a closed position in which the reverse fluid flow from the device and through the third valve is prevented.

42. The method of claim 41 further comprising connecting the third valve to the source, and moving the third valve to its open position when it receives fluid from the source and to its closed position when fluid flow from the source is terminated.

43. The method of claim 42 further comprising preventing fluid flow from the device to the source upon termination of fluid flow from the source and closing of the third valve.

44. The method of claim 41 further comprising connecting a flow line between the source and the second valve, and passing fluid in the line to the device upon termination of fluid flow from the source and closing of the third valve.

45. The method of claim 41 further comprising passing fluid from an additional source of fluid to the device upon termination of fluid flow from the source and closing of the third valve.

46. The method of claim 41 further comprising passing fluid from the source to the third valve to control its movement between the open and closed position.

47. The method of claim 41 further comprising connecting an additional source of fluid between the first-mentioned source and the second valve for supplying the additional fluid in response to termination of fluid flow from the first-mentioned source.

48. The method of claim 41 further comprising connecting a fourth valve between the second valve and the first valve and moving the fourth valve from an open position in which fluid flows from the second valve to the first valve, and to a closed position in which the fluid flow from the second valve to the first valve is prevented.

49. The method of claim 48 further comprising connecting the fourth valve to the source, and moving the fourth valve to its open position when fluid is received from the source and to its closed position in response to the termination of fluid flow from the source.

50. A method for controlling at least two hydraulically operated devices, comprising:

passing a portion of a first quantity of fluid from a source to at least one of the devices while selectively allowing another quantity of the fluid to pass to a first valve;

passing a portion of a second quantity of fluid from the source to at least one of the other devices while selectively allowing another quantity of the latter fluid to pass to the first valve; and adjusting the first valve to control the amount of fluid passed to the first valve and therefore the amount of fluid passed to the devices;

passing the first quantity of fluid through a second valve for passing to one of the devices and to the first valve; and passing the second quantity of fluid through a third valve for passing to one of the other devices and to the first valve.

51. The method of claim 50 further comprising:

connecting a fourth valve between the second valve and the one device, moving the fourth valve from an open position in which reverse fluid flow from the one device and through the fourth valve is permitted, and to a closed position in which the reverse fluid flow from the one device and through the fourth valve is prevented; and connecting a fifth valve between the third valve and the one other device, moving the fifth valve from an open position in which reverse fluid flow from the one other device and through the fifth valve is permitted, and to a closed position in which the reverse fluid flow from the one other device and through the fifth valve is prevented.

52. The method of claim 51 further comprising connecting each of the fourth and fifth valves to the source, and moving each of the fourth and fifth valves to its open position when it receives fluid from the source and to its closed position when fluid flow from the source is terminated.

53. The method of claim 52 further comprising preventing fluid flow from each device to the source upon termination of fluid flow from the source and closing of each of the fourth and fifth valves.

54. The method of claim 51 further comprising passing fluid from the source to each of the fourth and fifth valves to control its movement between the open and closed position.

55. The method of claim 51 further comprising connecting a flow line between the source and each of the second and third valves, and passing fluid in the line to each of the second and third valves and to each corresponding device upon termination of fluid flow from the source and closing of the fourth and fifth valves.

56. The method of claim 51 further comprising passing an additional quantity of fluid to each of the second and third valves and to each corresponding device upon termination of fluid flow from the source.

57. The method of claim 50 further comprising:

connecting a fourth valve between the second valve and the first valve and moving the fourth valve from an open position in which fluid flows from the second valve to the first valve, and to a closed position in which the fluid flow from the second value to the first valve is prevented; and connecting a fifth valve between the third valve and the first valve and moving the fifth valve from an open position in which fluid flows from the third valve to the first valve, and to a closed position in which the fluid flow from the third valve to the first valve is prevented.

58. The method of claim 57 further comprising connecting each of the fourth and fifth valves to the source, and moving each of the fourth and fifth valves to its open position when fluid is received from the source and to its closed position in response to the termination of fluid flow from the source.

* * * * *